US007263750B2

(12) United States Patent
Keene et al.

(10) Patent No.: US 7,263,750 B2
(45) Date of Patent: Sep. 4, 2007

(54) BUCKLE ASSEMBLY HAVING SINGLE RELEASE FOR MULTIPLE BELT CONNECTORS

(75) Inventors: Allen R. Keene, Scottsdale, AZ (US); David Thayer Merrill, Scottsdale, AZ (US)

(73) Assignee: AmSafe, Inc., Phoenix, AZ (US)

( * ) Notice: Subject to any disclaimer, the term of this patent is extended or adjusted under 35 U.S.C. 154(b) by 0 days.

(21) Appl. No.: 11/148,914

(22) Filed: Jun. 9, 2005

(65) Prior Publication Data

US 2006/0277727 A1 Dec. 14, 2006

(51) Int. Cl.
*A44B 11/00* (2006.01)

(52) U.S. Cl. ..... 24/638; 24/642; 24/639; 24/632; 24/637; 24/265 B; 297/484

(58) Field of Classification Search ..... 24/638, 24/637, 636, 633, 629, 648, 170, 646, 632, 24/265 BC
See application file for complete search history.

(56) References Cited

U.S. PATENT DOCUMENTS

| | | | | |
|---|---|---|---|---|
| 2,803,864 | A | 8/1957 | Bishaf | |
| 2,846,745 | A | 8/1958 | Lathrop | |
| 2,869,200 | A | 1/1959 | Phillips et al. | |
| 2,876,516 | A | 3/1959 | Cummings | |
| 2,893,088 | A | 7/1959 | Harper et al. | |
| 2,901,794 | A | 9/1959 | Prete, Jr. | |
| 3,029,487 | A | 4/1962 | Asai | |
| 3,118,208 | A | 1/1964 | Wexler | |
| 3,179,992 | A | 4/1965 | Murphy, Sr. | |
| 3,218,685 | A | 11/1965 | Atumi | |
| 3,226,791 | A | 1/1966 | Carter | |
| 3,256,576 | A | 6/1966 | Klove, Jr. et al. | |
| 3,289,261 | A | 12/1966 | Davis | |
| 3,312,502 | A * | 4/1967 | Coe | 297/481 |
| 3,369,842 | A | 2/1968 | Adams et al. | |
| 3,505,711 | A * | 4/1970 | Carter | 24/653 |
| 3,564,672 | A * | 2/1971 | McIntyre | 24/632 |
| 3,760,464 | A | 9/1973 | Higuchi | |
| 4,644,618 | A * | 2/1987 | Holmberg et al. | 24/630 |
| 4,646,400 | A | 3/1987 | Tanaka | |
| 4,679,852 | A | 7/1987 | Anthony et al. | |
| 5,088,160 | A | 2/1992 | Warrick | |
| 5,182,837 | A * | 2/1993 | Anthony et al. | 24/642 |
| 5,220,713 | A | 6/1993 | Lane, Jr. et al. | |
| 5,269,051 | A | 12/1993 | McFalls | |
| 5,369,855 | A | 12/1994 | Tokugawa | |
| 5,526,556 | A | 6/1996 | Czank | |
| 5,584,107 | A * | 12/1996 | Koyanagi et al. | 24/632 |
| 5,588,189 | A | 12/1996 | Gorman et al. | |
| 5,606,783 | A | 3/1997 | Gillis et al. | |
| 5,908,223 | A * | 6/1999 | Miller | 297/484 |
| 6,309,024 | B1 * | 10/2001 | Busch | 297/484 |

(Continued)

OTHER PUBLICATIONS

International Search Report and Written Opinion, for PCT/US06/22367, dated Sep. 18, 2006.

*Primary Examiner*—Katherine Mitchell
*Assistant Examiner*—Marcus Menezes
(74) *Attorney, Agent, or Firm*—Perkins Coie LLP

(57) ABSTRACT

A buckle assembly for a vehicle restraint system where the buckle assembly is adapted to receive a plurality of belt connectors, with the belt connectors being simultaneously released upon moving at least one handle to a release position.

21 Claims, 7 Drawing Sheets

U.S. PATENT DOCUMENTS 6,418,596 B2 7/2002 Haas
6,442,807 B1 9/2002 Adkisson
6,463,638 B1 10/2002 Pontaoe
6,513,208 B1 * 2/2003 Sack et al. ..... 24/632
6,543,101 B2 4/2003 Sack et al.
6,588,077 B2 7/2003 Katsuyama et al.
6,694,577 B2 2/2004 Di Perrero
6,711,790 B2 3/2004 Pontaoe
6,796,007 B1 9/2004 Anscher
6,868,591 B2 3/2005 Dingman et al.
6,871,876 B2 3/2005 Xu
2002/0017012 A1 2/2002 Sack et al.
2003/0106193 A1 6/2003 Pontaoe
2005/0115035 A1 6/2005 Karlsson

* cited by examiner

BUCKLE ASSEMBLY HAVING SINGLE RELEASE FOR MULTIPLE BELT CONNECTORS

BACKGROUND OF THE INVENTION

1. Field of the Invention

The present invention generally relates to buckle assemblies for use in seat belt or restraint systems that are designed to protect vehicle occupants during a crash event or to hold cargo in place. More particularly, the present invention is directed to a buckle assembly adapted to receive a plurality of independent belt connectors for engagement with a respective plurality of latch mechanisms where the plurality of latch mechanisms may be moved to a release position simultaneously.

2. Discussion of the Prior Art

It has become common place for aircraft, automobiles and other vehicles to have occupant restraint systems. Frequently, there are safety related laws or standards that require certain types of driver and passenger safety systems, depending on the type of vehicle in which the system is to be installed. The systems often utilize seat belts of the well known lap and shoulder belt varieties. Indeed, lap and shoulder belts are commonly combined to provide enhanced ability to restrain movement of an individual.

Typically the lap and shoulder belts are joined to each other or are coupled in some way to the same connector. This permits a single connector to engage a single buckle, facilitating release of the combined belt system via one release handle. However, it often can be awkward for the seat occupant to bring the belt assembly into position to engage the single connector with the buckle. Moreover, in the event of a need to quickly exit the seat and vehicle, such as in the event of an accident or other emergency, occupants can easily get entangled or caught in the combined lap and shoulder belt systems. Also, coupling the lap and shoulder belts to a single connector can impede repair or replacement of a portion of the belt system, such as an individual damaged lap or shoulder belt portion of the system.

Accordingly, it is desirable to provide a seat belt system with a single buckle that can be releasably connected to a plurality of belts, such as both a lap and a shoulder belt. It also is desirable for the plurality of belts to be separately connectable to the buckle, so as to reduce the likelihood of becoming entangled in the belts when releasing them and trying to quickly exit a vehicle, and to permit replacement of separate respective portions of the belt system. In addition, it would be highly advantageous to have the buckle include a handle by which one can affect release of the plurality of separately connected belts to facilitate rapid egress from the vehicle.

Also, in the event that one wishes to combine a lap and shoulder belt into one belt connector and further include a shoulder belt or other multiple belt arrangement into at least a second belt connector, it would be advantageous that such combination could be received in one buckle assembly and that the belt connectors could be released simultaneously by grasping and moving one handle.

Further it is desirable to provide a buckle assembly for a cargo hold down or restraint system that permits rapid release of multiple belt connectors with movement of a single handle.

The present invention addresses shortcomings in buckle assemblies of prior art occupant restraint systems, while providing the above mentioned desirable features.

SUMMARY OF THE INVENTION

The purpose and advantages of the invention will be set forth in and apparent from the description and drawings that follow, as well as will be learned by practice of the invention.

The present invention is generally embodied in a buckle assembly of a vehicle occupant or cargo restraint system. The buckle assembly may be used in any type of vehicle, whether it be an aircraft, spacecraft, truck, automobile, boat or other craft for use in the air, on land or in water. The buckle assembly also may be used with any vehicle occupant, whether the occupant is a vehicle operator or passenger, or for cargo.

Given the advantageous single release capability of the buckle assembly of the present invention, while suitable for use in all types of vehicles, it is ideally suitable for use in vehicles that may require rapid egress, such as aircraft, spacecraft, emergency or military vehicles. Moreover, the simple, reliable and durable structure shown in the lift latch mechanisms of the preferred embodiments, and that may be employed via the present invention, makes it suitable for use in locations where vehicles may encounter adverse environmental factors, such as airborne sand or dirt.

In a first aspect of the invention, the buckle assembly has a buckle base, a plurality of latches coupled to the buckle base with each latch adapted to engage one of a plurality of respective independent belt connectors, and at least one handle coupled to the buckle base and adapted to have at least latching and release positions wherein the plurality of connectors are simultaneously released when the at least one handle is in the release position.

In another aspect of the invention, the buckle base can be configured to have at least three parallel upstanding flanges which are adapted to receive at least two belt connectors, with each belt connector being received between a respective pair of upstanding flanges in a side-by-side orientation within the same plane.

In a further aspect of the invention, the buckle base can be configured to have at least a pair of parallel upstanding flanges which are adapted to receive at least two belt connectors, with each belt connector being received between the pair of upstanding flanges, and the belt connectors being received in a stacked orientation, in spaced, parallel planes.

Thus, the present invention presents a desirable alternative to buckle assemblies used in present vehicle occupant and cargo restraint systems. The invention permits a plurality of belts, such as lap and shoulder belts, or combinations thereof, or cargo restraint to be independently latched into a single buckle assembly, yet simultaneously released by lifting one release handle.

It is to be understood that both the foregoing general description and the following detailed description are exemplary and provided for purposes of explanation only, and are not restrictive of the invention, as claimed. Further features and objects of the present invention will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

Figure 1:
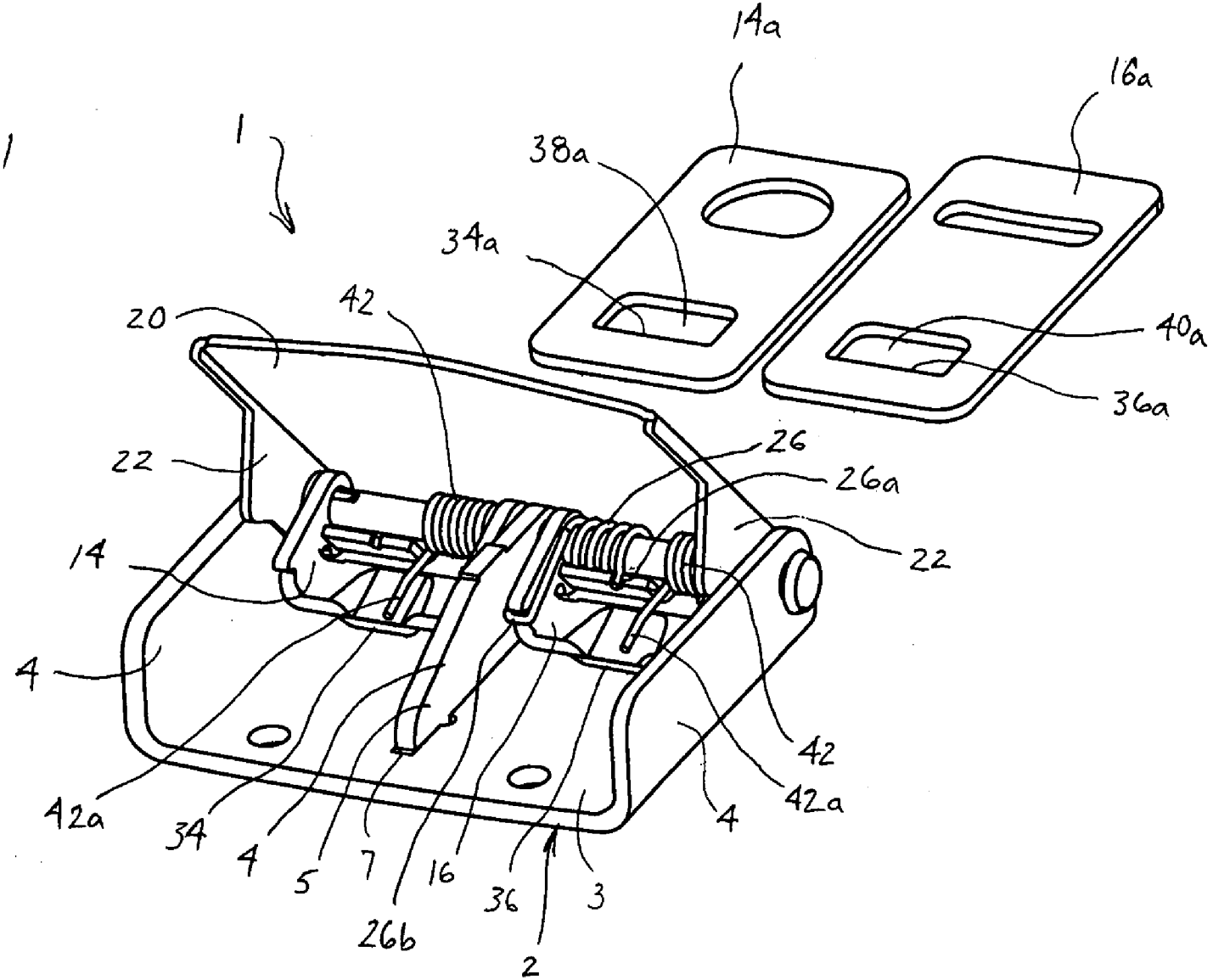
FIG. 1 is a perspective view of a buckle assembly having a pair of latches arranged next to each other, in the same plane, for engaging a respective pair of belt connectors consistent with the present invention.
Figure 2:
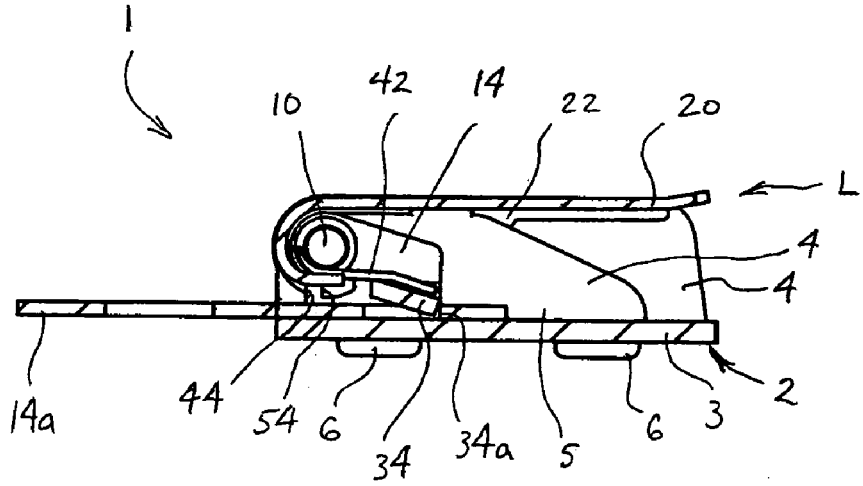
FIG. 2 is a sectioned side view of the buckle assembly of FIG. 1 with the handle in a latching position.
Figure 3:
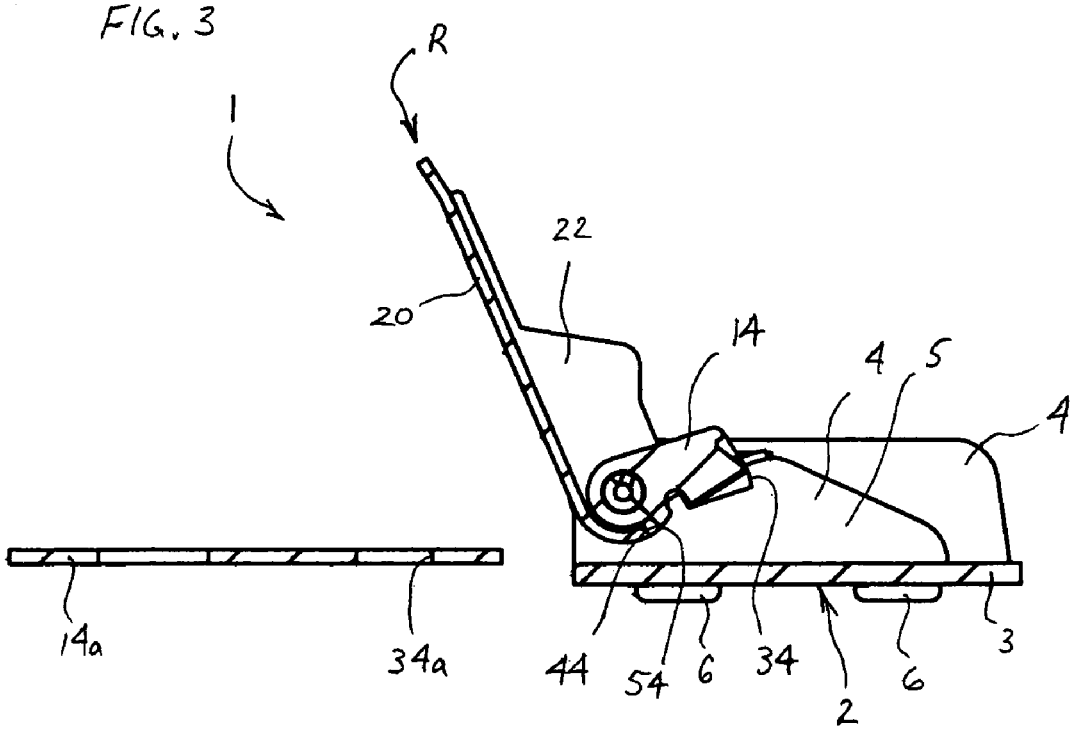
FIG. 3 is a sectioned side view of the buckle assembly of FIG. 1 with the handle in a release position.
Figure 4:
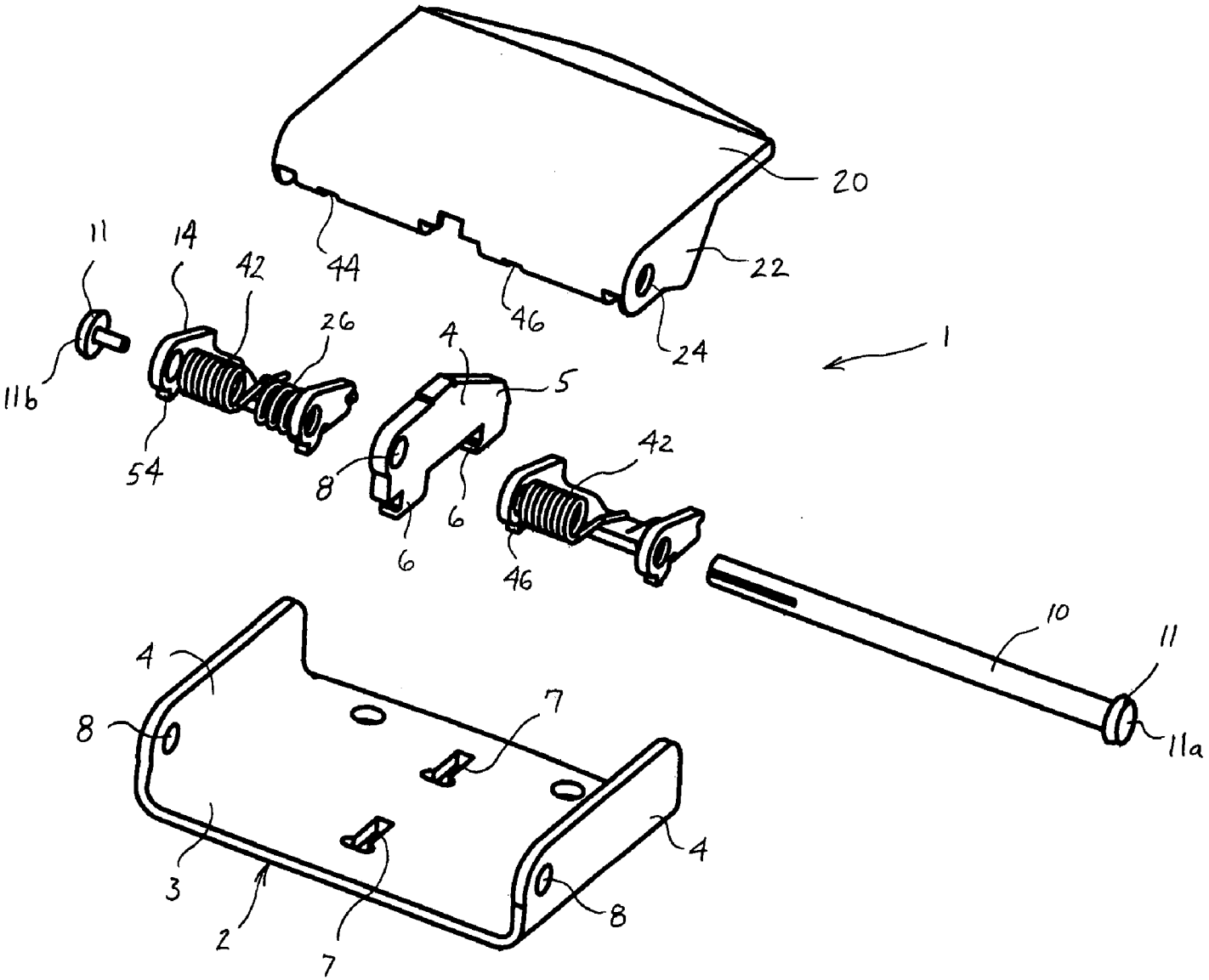
FIG. 4 is an exploded perspective view of the buckle assembly of FIG. 1.

It should be understood that the drawings are not to scale. While considerable mechanical details of a buckle assembly, including other plan and section views of the particular components, have been omitted, such details are considered well within the comprehension of those skilled in the art in light of the present disclosure. It also should be understood that the present invention is not limited to the preferred embodiments illustrated.

DETAILED DESCRIPTION OF THE PREFERRED EMBODIMENTS

Referring generally to FIGS. 1-11 and upon review of this description, it will be appreciated that the buckle assembly of the present invention generally may be embodied within numerous configurations.

Referring to a preferred embodiment in FIGS. 1-4, a buckle assembly 1 has a buckle base 2 having a bottom portion 3 and parallel spaced upstanding flanges 4. Buckle base 2 may be coupled to an occupant or cargo restraint system by direct attachment to a safety belt, cable or other suitable element not shown, and may include belt tensioning or other commonly desirable features. In the preferred embodiment in FIGS. 1-4, upstanding center flange 5 of buckle base 2 is a separate piece having tabs 6 that engage slotted apertures 7 in bottom portion 3. Flanges 4, 5 further have aligned respective apertures 8 therethrough. Aligned apertures 8 receive a pivot axle 10, which in the preferred embodiment is fixed in position by press fit, or by including a knurled engagement with at least one of the flange apertures 8 and use of cap ends 11. Cap ends 11 may be integrally formed as part of pivot axle 10, as shown with cap end 11*a*, or may be a separate piece attached to the end of pivot axle 10, such as by press fitting, threaded engagement or the like, as shown with cap end 11*b* which engages a slotted pivot axle end. It will be appreciated that in the preferred embodiment, pivot axle 10 extending through aperture 8 in separate center flange 5 also serves to lock center flange 5 into position. Alternatively, pivot axle 10 could be configured to be two separate pivot axles, each of which would engage an aperture 8 of an outer flange 4 of buckle base 2, such as by press fit, and they could either each engage aperture 8 in center flange 5, or they otherwise could be connected to each other with one passing through aperture 8 in center flange 5. It also will be appreciated that buckle base 2 could be formed, such as by molding, to include an integral center flange 5, or buckle base 2 could be constructed in a manner in which pivot axle 10 would not pass through an aperture in a center flange.

In the preferred embodiment of FIGS. 1-4, the plurality of latches is a pair of latches 14, 16, pivotally mounted on a pivot axle 10, and spaced side-by-side for receipt of respective belt connectors 14*a*, 16*a*, in the same plane. It is to be understood that, in this context, belt is used to refer to belts, straps, other webbing materials, ropes, cables, and the like. Buckle assembly 1 further includes handle 20 having downward projecting parallel flanges 22. Flanges 22 have aligned apertures 24 for pivotal mounting of handle 20 on pivot axle 10. Handle 20 is biased toward a latching position L by at least one resilient member or biasing element. In the first preferred embodiment, the resilient member is in the form of a single coil spring 26 which engages the handle at a first end 26*a* and engages a latch 16 at a second end 26*b*. While shown as a spring 26, it will be understood that other forms of resilient members, or multiple resilient members could be used. Latches 14, 16 each have a pawl 34, 36 adapted to engage respective forward wall 34*a*, 36*a* of apertures 38*a*, 40*a* in belt connectors 14*a*, 16*a* when handle 20 is in the latching position L. To establish and maintain the engagement of pawls 34, 36, each latch 14, 16 has a second resilient member 42 to bias the respective pawl toward the latched position. In this preferred embodiment, springs 42 engage the pivot axle 10 at a first end (not shown) and engage the latch at a second end 42*a*, although alternative configurations may be used.

To release the belt connectors 14*a*, 16*a*, handle 20 is pivoted to an angled release position R. When handle 20 is pivoted about pivot axle 10 toward the release position R, release edges 44, 46 on handle 20 engage respective release abutments 54, 56 on latches 14, 16, and cause latches 14, 16 to join handle 20 in pivoting about pivot axle 10 to a release position wherein pawls 34, 36 are lifted out of engagement with respective forward walls 34*a*, 36*a* of apertures 38*a*, 40*a* in belt connectors 14*a*, 16*a*. In this release position R, belt connectors 14*a*, 16*a* are simultaneously released and permitted to be withdrawn from buckle assembly 1. It will be understood that alternative configurations for causing movement of the latches upon movement of the handle may be utilized.

Figure 5:
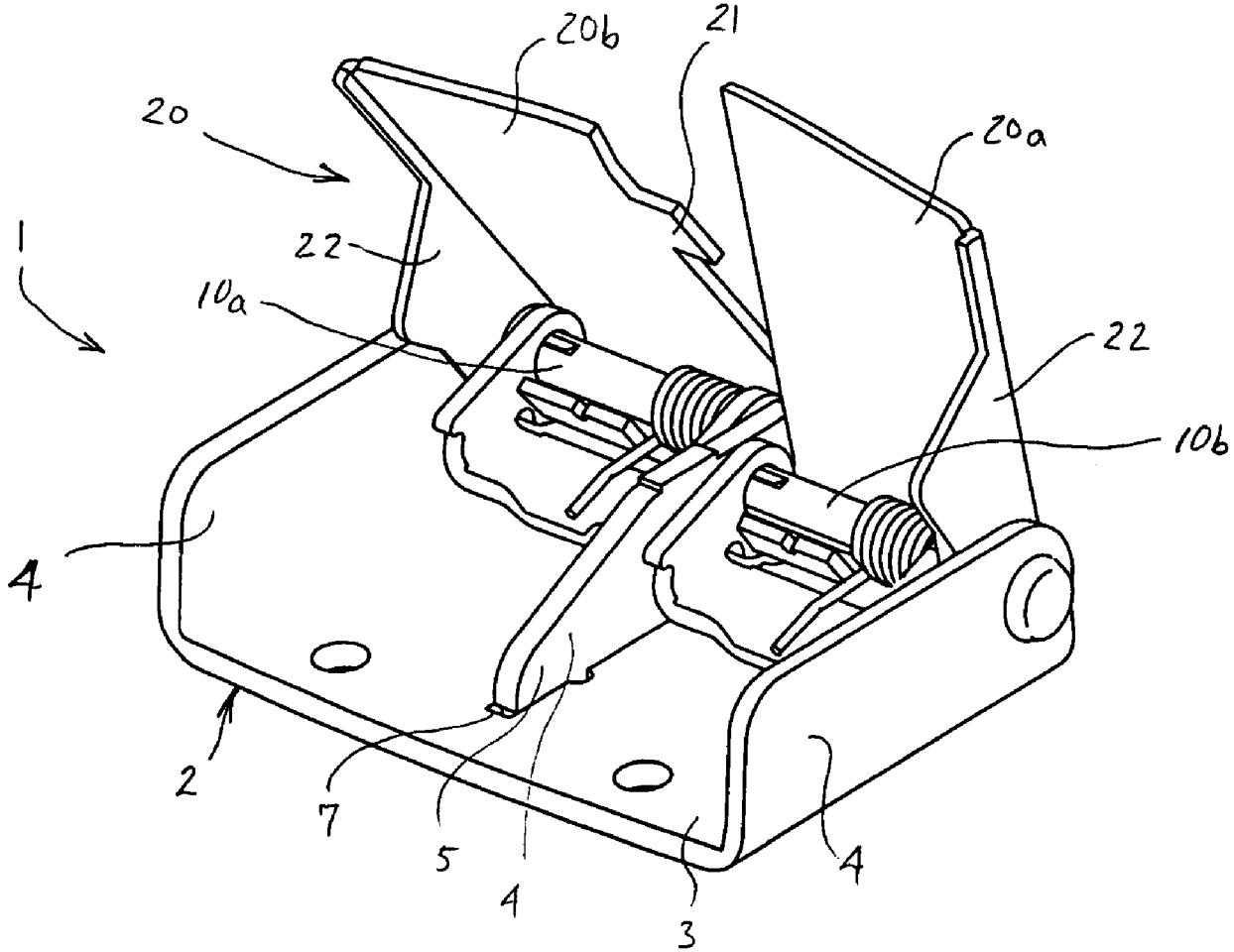
FIG. 5 is a perspective view of an alternative buckle assembly consistent with the invention but having a handle having at least two portions and staggered pivot axles.
Figure 6:
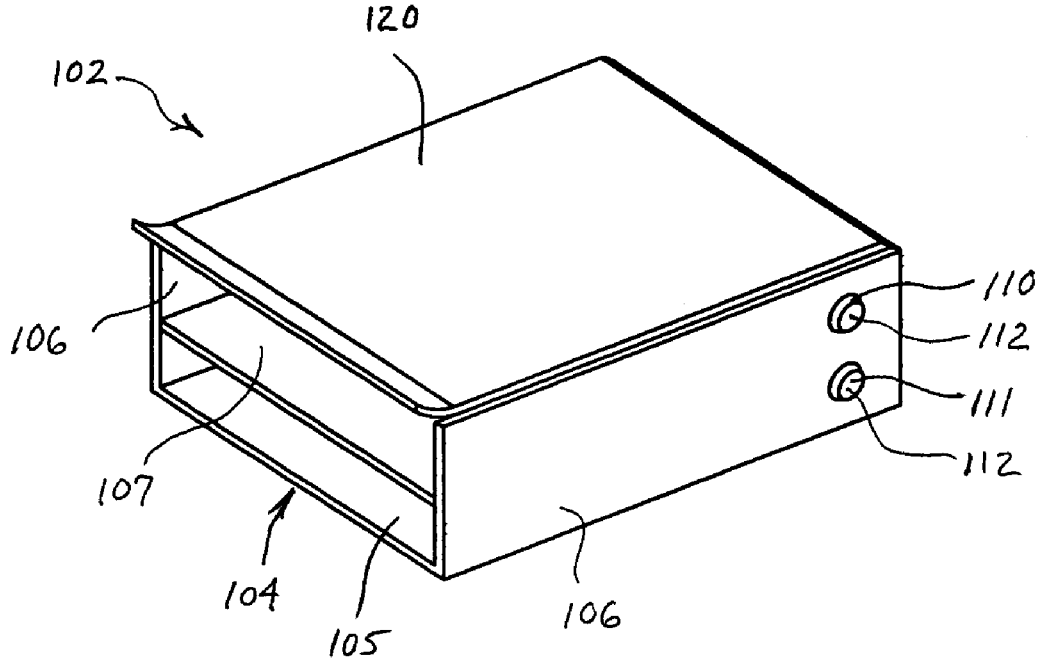
FIG. 6 is a perspective view of an alternative buckle assembly having a pair of latches arranged in spaced, parallel planes for engaging a respective pair of belt connectors in stacked relation to each other consistent with the present invention.
Figure 7:
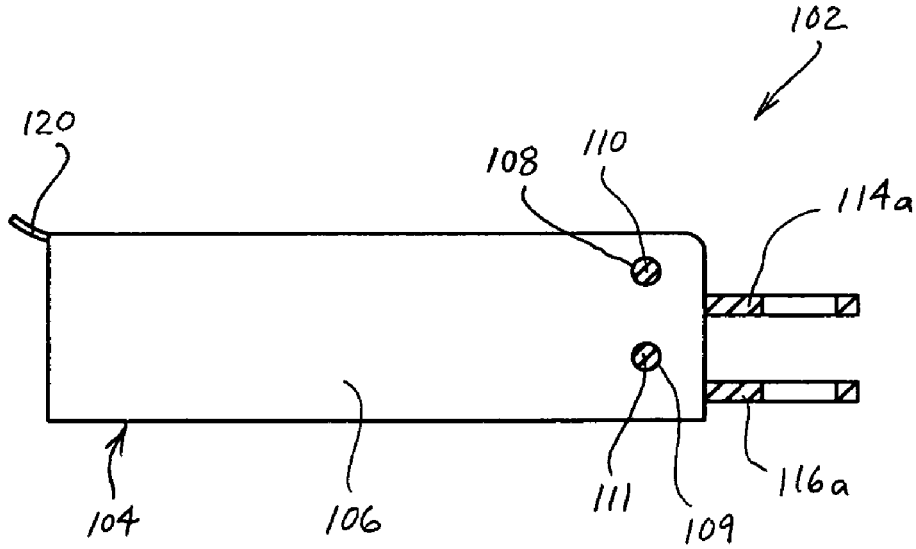
FIG. 7 is a side view of the alternative buckle assembly of FIG. 6 with a pair of belt connectors inserted and shown in cross-section.
Figure 8:
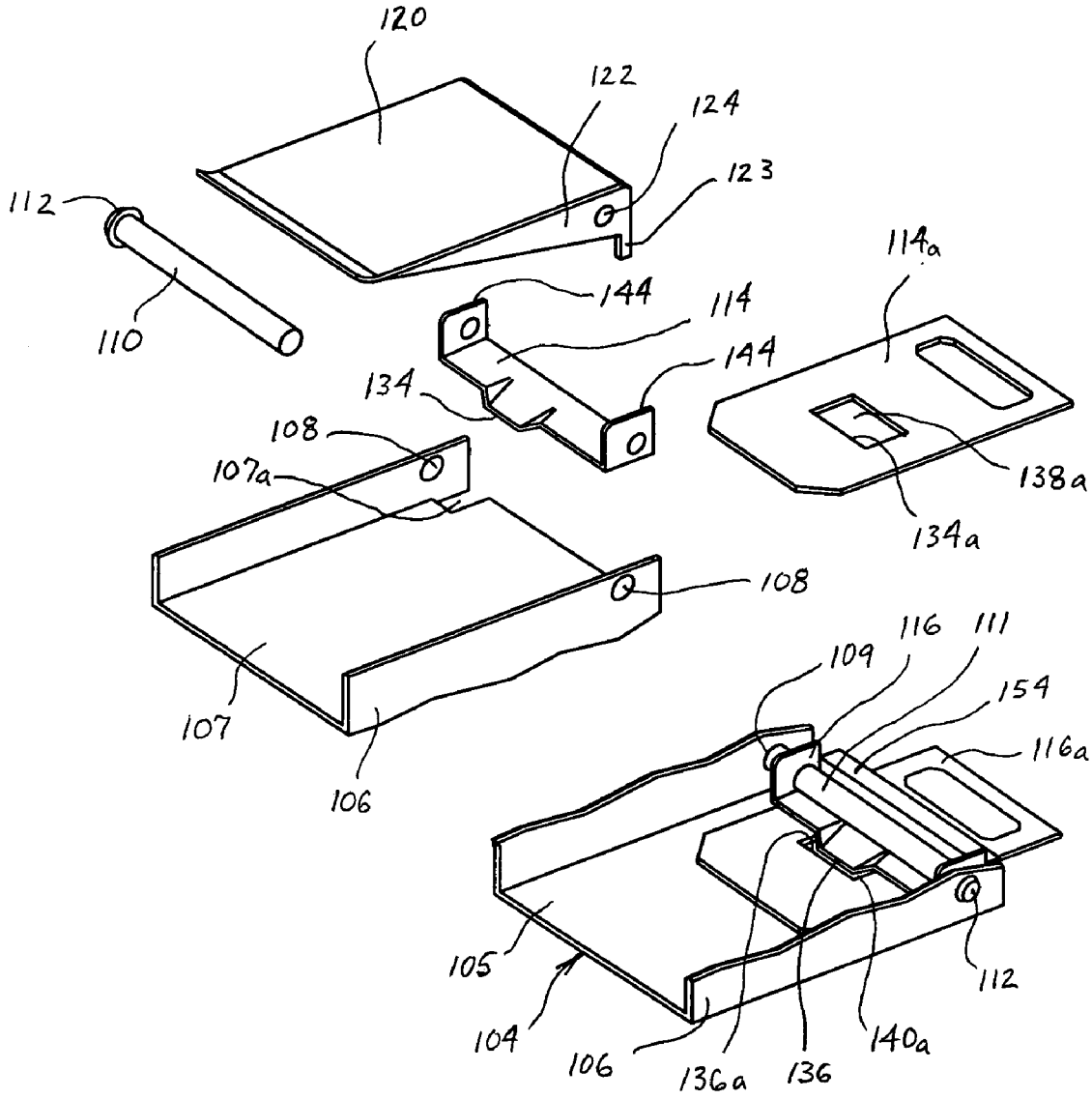
FIG. 8 is a partially exploded, perspective view of the alternative buckle assembly of FIG. 6 with the assembly separated into upper and lower sections and with the resilient members removed to better illustrate the configurations of the respective latches.
Figure 9:
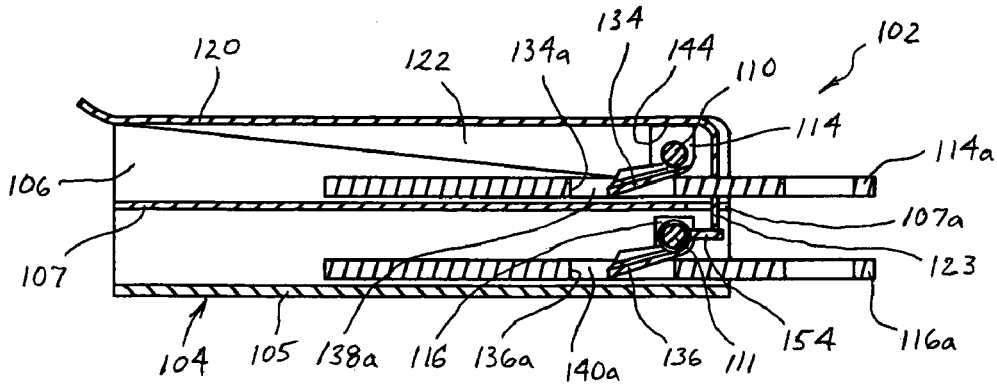
FIG. 9 is a sectioned side view of the alternative buckle assembly of FIG. 6 with the handle in a latching position.
Figure 10:
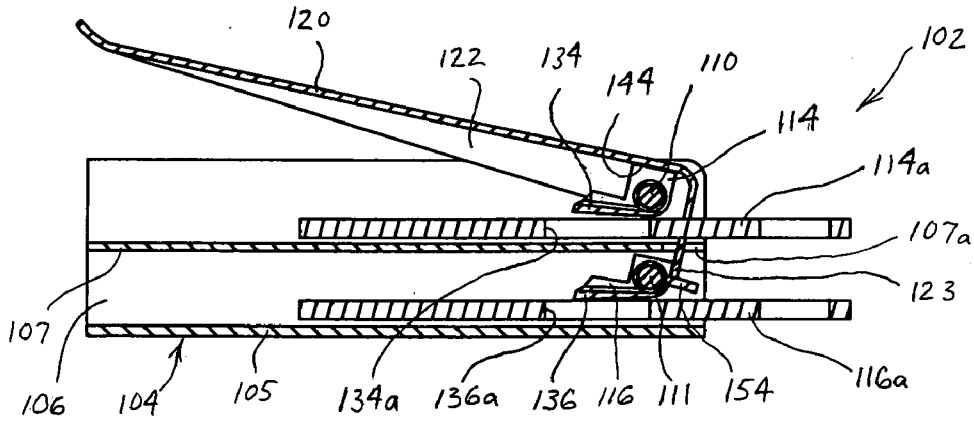
FIG. 10 is a sectioned side view of the alternative buckle assembly of FIG. 6 with the handle in a release position.

The alternative preferred embodiment shown in FIG. 5 has a handle 20' having separate portions 20'*a*, 20'*b*. This embodiment permits individual release of a selected belt connector, such as a shoulder belt connector, for instance, by moving handle portion 20'*a* to a release position, while leaving handle portion 20'*b* in a latching position. The multi-piece handle 20' also permits selective simultaneous release of all belt connectors by moving handle portion 20'*b* to a release position. This is affected by tab 21 which extends to the side of handle portion 20'*b*. Tab 21 is configured to have a portion positioned behind handle portion 20'*a*, to cause handle portion 20'*a* to be moved along with handle portion 20'*b* when handle portion 20'*b* is moved.

The embodiment in FIG. 5 is shown without resilient members to bias the handles to the latching position for ease of illustration of the pivot axles. This embodiment illustrates that each latch 14, 16 may be pivotally coupled to the buckle base by a separate pivot axle 10*a*, 10*b* respectively. The separate pivot axles 10*a*, 10*b*, can but need not share a common axis if a handle 20 is configured to have two portions.

Referring now to an alternative preferred embodiment in FIGS. 6-10, a buckle assembly 102 has a buckle base 104 which, as with the prior embodiments, may be constructed in various ways and is intended to be coupled to further components in an occupant or cargo restraint system. In this embodiment, buckle base 104 has a bottom portion 105, a parallel spaced upstanding flanges 106 and a center portion 107 extending between upstanding flanges 106. Center portion 107 has a notch 107*a* along each side at its rear edge. Flanges 106 further have a pair of aligned respective apertures 108, 109 therethrough. Aligned apertures 108 receive a pivot axle 110, while aligned apertures 109 receive a pivot axle 111, parallel to pivot axle 110. As with pivot axle 10 in the first preferred embodiment, pivot axles 110, 111 are fixed in position in engagement with apertures 108, 109 by press fitting, knurled engagement or other suitable means, and may include comparable capped ends 112 integrally formed as part of pivot axles 110, 111 or attached thereto.

In the alternative embodiment shown in FIGS. 6-10, the plurality of latches is a pair of latches 114, 116, pivotally mounted on the parallel pivot axles 110, 111, in parallel planes for receipt of respective belt connectors 114*a*, 116*a* in stacked relation to each other. Buckle assembly 102 further includes handle 120 having downward projecting parallel flanges 122 which include downward projecting tabs 123. Flanges 122 have aligned apertures 124 for pivotal mounting of handle 120 on pivot axle 110. Handle 120 is biased toward a latching position L by a resilient member which may be similar to that in the other preferred embodiments, but is not shown. Latches 114, 116 each have a pawl 134, 136 adapted to engage respective forward wall 134*a*, 136*a* of apertures 138*a*, 140*a* in belt connectors 114*a*, 116*a* when handle 120 is in the latching position L'. To establish and maintain the engagement of pawls 134, 136, each latch 114, 116 may have a resilient member similar to that in the other preferred embodiments, but not shown, to bias the respective pawl toward the latched position.

To release the belt connectors 114*a*, 116*a*, handle 120 is pivoted to an angled release position R'. When handle 120 is pivoted about pivot axle 110 toward the release position R', the upper edges 144 of the upper latch 114 engage the underside of handle 120 and cause latch 114 to pivot about pivot axle 110 along with handle 120. Because of this configuration which utilizes a relatively low lash, direct drive of upper latch 114 by the underside of handle 120, it will be appreciated that optionally handle 120 and upper latch 114 may be biased toward the latching position by use of a single resilient member that tends to bias handle 120 or latch 114 toward the latching position. Referring now to the interaction with lower latch 116, when handle 120 is moved to a release position, the downward projecting tabs 123 at the rear end of handle 120 engage a rearward projecting tab 154 of the lower latch 116, simultaneously causing latch 116 to move to a release position. In the release position, pawls 134, 136 are lifted out of engagement with respective forward walls 134*a*, 136*a* of apertures 138*a*, 140*a* in belt connectors 114*a*, 116*a*. Thus, in this release position R', belt connectors 114*a*, 116*a* are simultaneously released and permitted to be withdrawn from buckle assembly 102.

Figure 11:
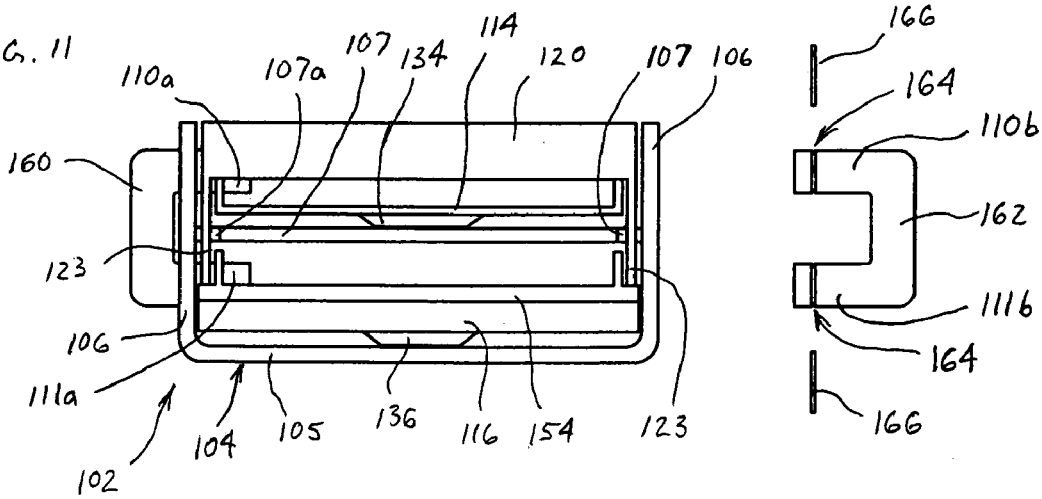
FIG. 11 is a frontal end view of the alternative buckle assembly of FIG. 6 but having alternative pivot axle structures.

Now turning to the further preferred embodiment in FIG. 11. This embodiment illustrates additional alternative ways of configuring the pivot axles. For instance, on the left side, a C-shaped portion 160 provides a pair of spaced stub shafts that serve as pivot axles 110*a*, 111*a* for the left side of buckle assembly 102. Pivot axles 110*a*, 111*a* of C-shaped portion 160 may be press fit into the apertures in upstanding flanges 106, or held in place by other suitable fasteners or means of attachment. For instance, on the right side, a further C-shaped portion 162 provides a corresponding respective pair of spaced stub shafts that serve as pivot axles 110*b*, 111*b* for the right side of buckle assembly 102, and which will be inserted through the apertures in upstanding flange 106. In this case, pivot axles 110*b*, 111*b* of C-shaped portion 162 also have grooves 164 to receive clips 166 to fasten C-shaped portion 162 to upstanding flange 106. Thus, FIG. 11 presents further examples of alternative ways of providing the pivot axles. Similarly, it will be appreciated that individual stub shaft portions (not shown) also may be used, such as via press fit, to provide the pivot axles.

In the preferred embodiments, the latches and pivot axles are preferably made of steel, aluminum, alloys, plastics or other suitable rigid materials. To reduce weight, the base plates and handles preferably are made of aluminum, but could be made of steel, alloys, plastics or other suitable rigid materials. The resilient members may be made of spring steel, such as in a coil spring, or any other suitable material and configuration to perform the biasing function of a resilient member.

It will be appreciated that a buckle assembly in accordance with the present invention may be provided in various configurations that will receive and latch at least two independent belt connectors, but still provide for simultaneous release of all belt connectors upon moving a handle to a release position. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such a buckle assembly without departing from the scope or spirit of the present invention, and that the claims are not limited to the preferred embodiments illustrated.

What is claimed is:

1. A buckle assembly for attachment to a plurality of flat, plate like belt connectors, wherein each of the belt connectors includes a latching abutment located adjacent to an upper surface thereof, the buckle assembly comprising:

a. a buckle base having a bottom portion and parallel spaced apart upstanding parallel flanges at least along lateral edges of the bottom portion;

b. at least two spaced apart latching mechanisms mounted in parallel with respect to each other between the spaced apart upstanding flanges of the bottom portion, wherein each of the spaced apart latching mechanisms includes (i) a separate latch pawl that is spaced apart from the other one or more latch pawls, wherein each of the separate latch pawls is independently movable relative to the other one or more latch pawls to a position engaging the latching abutment of one of the belt connectors, and (ii) a biasing element urging the latch pawl toward the engaging position; and c. at least one operating handle movable between positions at which the latch pawls of the latching mechanisms are caused to engage and to disengage connection between the buckle and the belt connectors, the operating handle being configured to serve as a top cover plate for the buckle assembly.

2. A buckle assembly in accordance with claim 1, wherein the handle is pivotally coupled to the buckle base.

3. A buckle assembly in accordance with claim 1, wherein the buckle base has at least two parallel upstanding flanges.

4. A buckle assembly in accordance with claim 1, further comprising at least one resilient member that biases the handle toward the latching position.

5. A buckle assembly in accordance with claim 1, wherein the buckle base has at least three parallel upstanding flanges.

6. buckle assembly in accordance with claim 5, wherein the buckle base is adapted to receive at least two belt connectors, with each belt connector being received between a respective pair of upstanding flanges.

7. A buckle assembly in accordance with claim 5, further comprising at least one pivot axle coupled to the buckle base.

8. A buckle assembly in accordance with claim 5, further comprising at least two pivot axles coupled to the buckle base.

9. A buckle assembly in accordance with claim 5, wherein at least one pivot axle is received in apertures in the upstanding flanges.

10. A buckle assembly in accordance with claim 9, wherein at least one pivot axle is comprised of at least two portions.

11. A buckle assembly in accordance with claim 9, wherein each of the plurality of latches is pivotally connected to at least one pivot axle.

12. A buckle assembly in accordance with claim 11, wherein the handle engages each of the plurality of latches to move the latches to release each of the respective belt connectors when the handle is pivoted to the release position.

13. A buckle assembly in accordance with claim 11, wherein each of the plurality of latches further comprises a pawl to engage a wall of an aperture in a respective belt connector when the respective belt connector is received by the buckle assembly.

14. A buckle assembly in accordance with claim 3, further comprising at least two pivot axles coupled to the at least two parallel upstanding flanges.

15. A buckle assembly in accordance with claim 14, wherein the at least two pivot axles each are comprised of at least two portions.

16. A buckle assembly in accordance with claim 15, wherein the handle is pivotally coupled to the buckle base.

17. A buckle assembly in accordance with claim 15, wherein the handle engages each of the plurality of latches to move the latches to release each of the respective belt connectors when the handle is pivoted to the release position.

18. A buckle assembly in accordance with claim 14, wherein each respective pivot axle is received in respective aligned apertures in the at least two upstanding flanges.

19. A buckle assembly in accordance with claim 14, wherein each of the plurality of latches is pivotally connected to at least one pivot axle.

20. A buckle assembly in accordance with claim 19, wherein each of the plurality of latches further comprises a pawl to engage a wall of an aperture in a respective belt connector when the belt connector is received by the buckle assembly.

21. A buckle assembly for attachment to a flat, plate like belt connector with upper and lower surfaces and having a latching abutment located on the upper surface thereof, the buckle assembly comprising:

a. a buckle base having a bottom portion and parallel spaced apart upstanding parallel flanges at least along lateral edges of the bottom portion.

b. at least two spaced apart latching mechanisms mounted in parallel with respect to each other between the spaced upstanding flanges of the bottom portion at locations enabling operative interaction with the latch engaging abutment; wherein the latching mechanisms include (i) latch pawls movable between a position engaging with the belt connector abutment and a non-engaging position removed from the abutment; and (ii) a biasing element urging the pawls toward the engaging position; and c. two operating handles coupled to the buckle base which ; permit a first respective handle to selectively release at least one respective belt connector and a second respective handle to simultaneously release one or both; belt connectors, wherein at least one of the two operating handles is movable between positions at which the latch pawl of the respective latching mechanism is caused to engage and to disengage connection between the respective buckle and the belt connector, the at least one of the two operating handles being configured to serve as a top cover plate for the buckle assembly.

* * * * *

UNITED STATES PATENT AND TRADEMARK OFFICE

CERTIFICATE OF CORRECTION

PATENT NO. : 7,263,750 B2
APPLICATION NO. : 11/148914
DATED : September 4, 2007
INVENTOR(S) : Allen R. Keene and David Thayer Merrill It is certified that error appears in the above-identified patent and that said Letters Patent is hereby corrected as shown below:

| | |
|---|---|
| Column 6, line 67 | Add --assembly-- between "buckle" and "and" |
| Column 8, line 23 | Change the period to a semicolon; |
| Column 8, line 28 | Change the semicolon to a comma; |
| Column 8, line 31 | Change the semicolon to a comma; |
| Column 8, line 35 | Delete the semicolon; |
| Column 8, line 38 | Delete the semicolon. |

Signed and Sealed this

Eighteenth Day of March, 2008

JON W. DUDAS
*Director of the United States Patent and Trademark Office*